US007555920B2

(12) United States Patent
Weihing et al.

(10) Patent No.: US 7,555,920 B2
(45) Date of Patent: Jul. 7, 2009

(54) COMPOUND NEEDLE WITH FLANGED SLIDER CHANNEL

(75) Inventors: Frank Weihing, Gomaringen (DE); Klaus Kirchmair, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/213,169

(22) Filed: Jun. 16, 2008

(65) Prior Publication Data

US 2008/0307832 A1 Dec. 18, 2008

(51) Int. Cl.
*D04B 35/06* (2006.01)

(52) U.S. Cl. ..... 66/120

(58) Field of Classification Search ..... 66/116, 66/120, 123, 117
See application file for complete search history.

(56) References Cited

U.S. PATENT DOCUMENTS

| | | | | |
|---|---|---|---|---|
| 1,398,813 | A * | 11/1921 | Taft | 66/120 |
| 1,727,769 | A * | 9/1929 | Haveson | 66/117 |
| 2,129,327 | A * | 9/1938 | Kataja | 66/120 |
| 2,778,211 | A * | 1/1957 | Rhoads | 66/120 |
| 3,229,485 | A * | 1/1966 | Peschel et al. | 66/120 |
| 3,584,481 | A * | 6/1971 | Hayashi | 66/120 |
| 4,584,852 | A * | 4/1986 | Beck et al. | 66/120 |

FOREIGN PATENT DOCUMENTS

| | | |
|---|---|---|
| DE | 1 635 847 | 8/1972 |
| DE | 30 23 586 | 9/1981 |
| FR | 1 330 775 | 6/1963 |
| GB | 734 976 | 8/1955 |

* cited by examiner

*Primary Examiner*—Danny Worrell
(74) *Attorney, Agent, or Firm*—Norman N. Kunitz; Fitch, Even, Tabin & Flannery

(57) ABSTRACT

A compound needle (1) having a slider channel (5) that is delimited by two lateral walls (8, 9). At least one of the lateral walls (8, 9) has, in its upper edge region (11, 12), a reduced thickness (d1). The edge (11) of the lateral wall (8) is bent, respectively, toward the other lateral wall (9). Due to the reduced thickness (d1), a narrow bending radius can be achieved, as a result of which the needle channel (5) can be better approximated—in cross-section—to a rectangular form than was possible until now. This allows the slider (4) to better utilize the clearance height of the slider channel (5).

9 Claims, 2 Drawing Sheets

COMPOUND NEEDLE WITH FLANGED SLIDER CHANNEL

CROSS-REFERENCE TO RELATED APPLICATION

This application claims the priority of European Patent Application No. 07 011 848.4, filed Jun. 16, 2007, the subject matter of which, in its entirety, is incorporated herein by reference.

BACKGROUND OF THE INVENTION

The invention relates to a compound needle for use in stitch-forming machines, in particular knitting machines, such as circular knitting machines, crocheting Galon machines, knitting machines or other stitch-forming textile machines. Compound needles have a needle body with a hook that is used for stitch formation. The hook delimits the inside space of the hook that must be opened and closed in a controlled manner. This is achieved by a slider supported on the needle body, said slider being supported in such a manner that it can be shifted along the needle body. The needle body and the slider each have a foot that is actuated by a needle lock. A relative movement between the slider and the needle body opens and closes the inside space of the hook.

Such slider needles have been known from document DE 1 635 847 A1, for example. This publication discloses a compound needle with a needle base having a tube-shaped section. This tube-shaped section encloses a longitudinally aligned oval channel that accommodates the slider. The walls delimiting the tube-shaped section have a uniform thickness all around the circumference of the tube section.

This type of slider channel results in relatively large bending radii at the upper and lower floors of the slider channel. In order to allow the arrangement of the slider so that it is easily movable in the slider channel, the slider must have flanges that are precisely aligned in a parallel manner. The maximum height of the slider may extend only up to the beginning of the respective upper and lower curves of the slider channel. Therefore, this design has a relatively small slider height, thus reducing the stability and functionality of the slider.

However, it would also not be a good idea to leave the slider channel open, for example on its upper side, in order to create more room for the slider and in order to avoid rounded surfaces that might otherwise result in a jamming of the slider. It must be considered that the slider may fall out of the compound needle when the slider channels are open, this being the case, for example, when the needle is placed in a machine or removed therefrom.

Document DE 33 25 767 C1 has disclosed a solution to the aforementioned technical problem, said solution being suitable for short slider accommodation spaces. In this case, the needle body is provided with overlapping milled-out portions that complement each other to form a slider channel. As regards longer compound needles, this design has not been accepted on the market.

Considering this, it is the object of the invention to provide a compound needle that can be easily manufactured and that ensures precise guiding of the slider.

SUMMARY OF THE INVENTION

This object is achieved with the compound needle in accordance with Claim 1:

The compound needle in accordance with the invention has a needle body with a slider channel in which a slider is arranged so that it can be shifted in said channel. The slider channel is delimited by two lateral walls. At least one of the lateral walls has on its upper end an edge with reduced thickness. This edge is curved toward the other lateral wall in order to close the slider channel at the top.

With the use of this design, highly stable compound needles of any length can be produced. As a result of the reduced thickness of the upper edge, said edge may be bent at a small bending radius. Consequently, the configuration of the slider channel is largely rectangular. The slider supported in the slider channel may have a relatively great height, this allowing the easy guiding of the slider, on the one hand, and its stable design, on the other hand.

Furthermore, considering the manufacture of the compound needles, the flanging of the slit walls requires less force because of the reduced thickness and thus prevents the lateral walls from being bent improperly. Inasmuch as the thickness is reduced only in the edge region of the lateral walls, the stability of the lateral walls is not substantially impaired or not at all impaired.

Considering the compound needle in accordance with the invention, the height of the slider may be selected greater than in the case of needles having a uniform lateral wall thickness and having lateral walls with upper opposing flanges. The reduction of the thickness of the lateral wall at its respective upper edge creates a free space that may be occupied by the slider. If a smaller slider height is sufficient, the additionally gained free space, in contrast, permits an overall smaller dimension of the height of the shaft of the knitting machine needle in the stitch-forming region (jaw height).

The upper edges of the compound needle may define, together, a joint, e.g., in the form of a gap, where said edges may be in contact with each other. This allows that they may be joined together, for example, by laser welding spots or other connecting means. However, it is also possible to form configure the upper edges of the compound needle so that they overlap each other. One the one hand, this too allows a particularly secure mechanical closure of the slider channel and a connection of the edges of the lateral walls between each other. On the other hand, it is also possible to leave open a gap between the two edges, whereby, however, said gap is narrower than the slider channel. Such a gap may be desirable when, for example, a lubricant is to enter or leave the slider channel.

Preferably, the thickness of the lateral wall is reduced by a step, a ramp or similar means. The step, ramp or other shape utilized for changing the wall thickness is preferably located on the inside of the lateral wall. As a result of this, the curved region of the bent edge is displaced out of the rectangular inside space or cross-section of the slider channel, thus maximizing the cross-sectional surface area of the slider channel that can be used by the slider.

Preferably, both lateral walls have a reduced thickness on their respective upper edges, so that the two edges having the reduced thickness can be bent toward each other. Referring to a preferred embodiment, the lateral walls of the compound needle are configured symmetrically with respect to each other and relative to a center plane. This avoids any twisting of the slider needle under load or during extended use.

Preferably, the thickness of the lateral walls in the offset region should not be less than 0.1 mm. In special cases, however, it may be less than that. A reduction of the thickness by 0.05 mm is sufficient for the slider to be able to also use the space above the step. Thus, the slider may have a height that exceeds ⅔ of the total height of the slider channel.

Additional details of advantageous embodiments of the invention are obvious from the claims, the drawings and the description. The drawings show exemplary embodiments of the invention. In so doing, the description is restricted to essential aspects of the invention and to miscellaneous situations. The drawings disclose additional details and are to be considered supplementary.

DETAILED DESCRIPTION OF THE INVENTION

Figure 1:
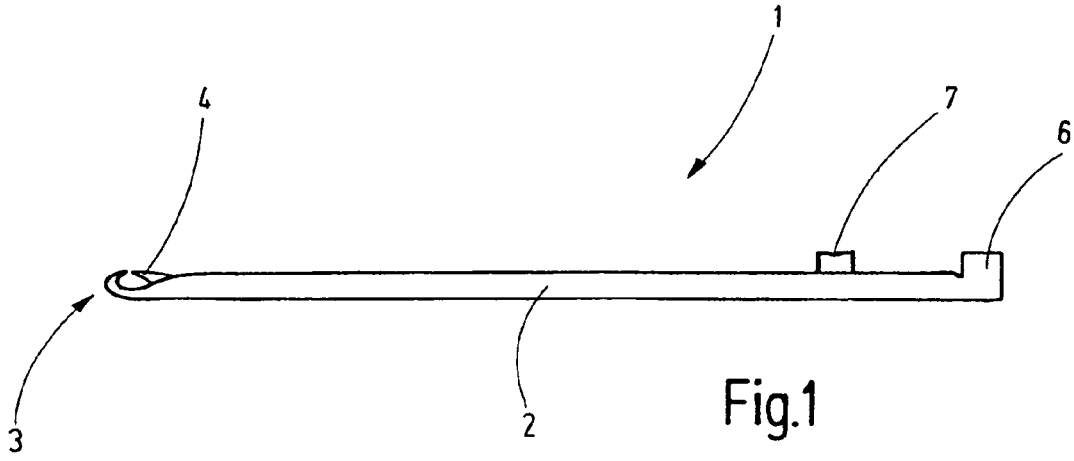
FIG. 1 is a schematic side view of a compound needle.

FIG. 1 shows a compound needle 1 which is designed for use in a stitch-forming machine. The compound needle 1 has a needle body 2 which has an elongated shape and has a hook 3 at its end. This hook is associated with a slider 4, which is supported on or in the needle body 2 or so as to be movable alongside the needle body 2. The end of the slider 4 projects from a slider channel 5, as is obvious, e.g., from FIG. 2 or 4, and can be moved toward, or away from, the tip of the hook 3. In order to move the needle body 2 and the slider 4 together and also relative to each other, the needle body 2 and the slider 4 are each provided with a foot 6, 7, said foot being in engagement with a needle bar or a needle lock during operation.

Figure 2:
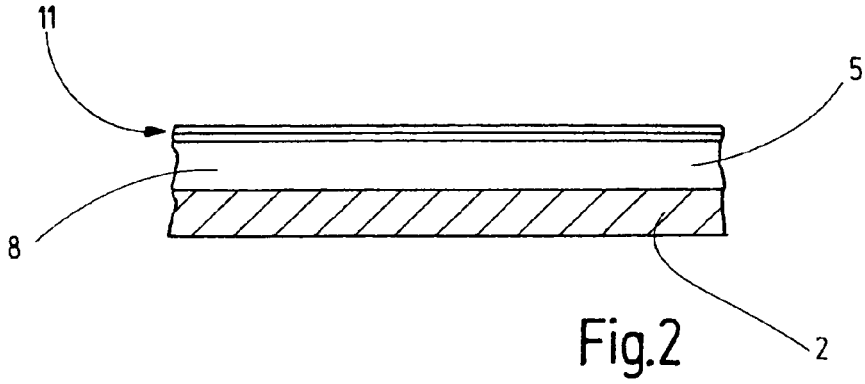
FIG. 2 is a detail, longitudinally in section, of the compound needle in accordance with FIG. 1, depicted in a different size.

As is shown by FIG. 2, the slider channel 5 extends, in longitudinal direction, through the needle body 2. Said channel is delimited by the lateral walls 8, 9 (FIG. 4), whereby a preferably essentially planar or flat floor 10 is formed between said walls.

The lateral walls 8, 9 delimit, between them, a slit. They have flat interior sides and are aligned preferably parallel to each other. The slider 4 is supported—with minimal play—between the lateral walls 8, 9.

Figure 4:
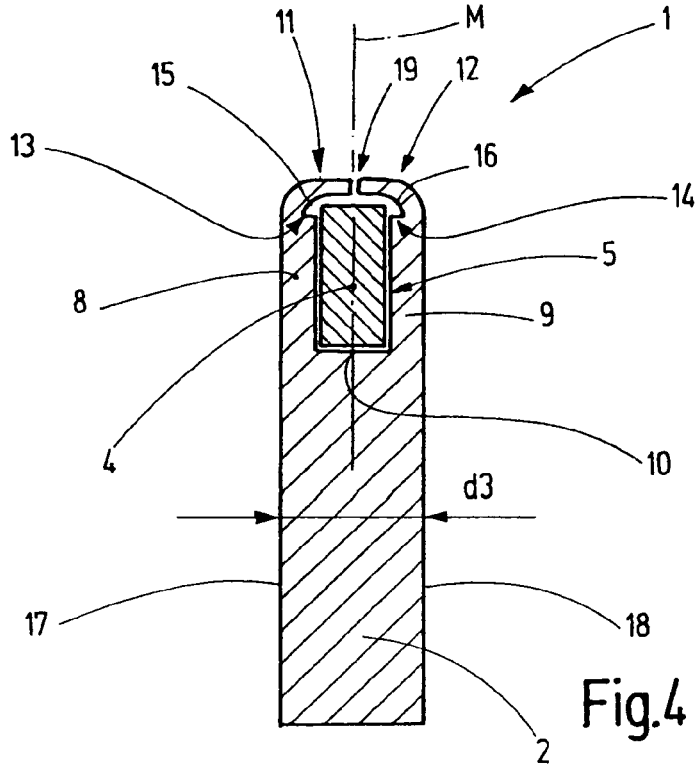
FIG. 4 is a cross-sectional view, greatly enlarged for explanation, of the compound needle in accordance with FIG. 1.

As shown by FIG. 4, at least one of the lateral walls 8, 9, preferably, however, both, have an upper edge 11, 12 having a thickness d1 that is smaller than the thickness d2 of the respective lateral wall 8 or 9. As is obvious from the example of FIG. 5, the thickness d1 or d2 is respectively measured perpendicular to the corresponding wall part.

An appropriate molded element, for example, having the shape of a step 13, 14, is preferably provided on the inside of each lateral wall 8, 9 in order to reduce the thickness d2 to the thickness d1. The thickness d2 of the wall 8, 9 changes at the step 13, 14 to a thickness d1, preferably $\geqq$0.1 mm. However, in individual cases the thickness d1 may also be reduced to lower values such as, for example, 0.05 mm. Each edge 11, 12, as well as each lateral wall 8, 9, has flat sides that are parallel to each other. The edge 11, 12 may also be wedge-shaped, i.e., it may taper down, or even taper up, from the step 13, 14 toward its terminal edge.

As is shown, in particular, by FIG. 4, the edges 11, 12 that are configured in such a manner are curved toward each other. In so doing they define a throat 15, 16 that faces the slider channel 5. The radius of this cylindrically curved surface or throat 15, 16 is preferably smaller than half the thickness d3 of the needle body 2. In accordance with FIG. 4, the thickness d3 is the distance measured between said needle body's preferably flat lateral surfaces 17, 18.

Figure 3:
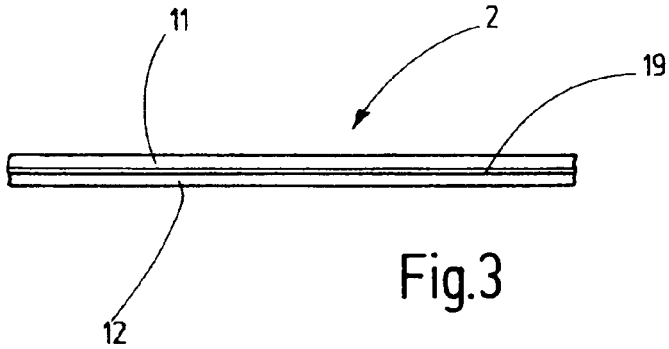
FIG. 3 is a plan view of a detail of the compound needle in accordance with FIG. 2.

The two edges 11, 12 may contact each other or, together, delimit a gap, as shown by FIGS. 3 and 4. This gap 19 may be used to allow a lubricant to enter into the slider channel 5 or to exit therefrom.

In order to manufacture the compound needle 1 and, in particular for the formation of the slider channel 5, the needle body 2 is first provided—on its narrow upper side—with a slit. In so doing and thereafter, the upper edges 11, 12 are made with reduced thickness. Then the slider 4 having a cross-section, said cross-section preferably being rectangular or also oval or also curved only on its upper side, is placed in the slider channel 5. Finally, the edges 11, 12 are bent toward each other in order to close the slider channel 5 toward the top.

Also conceivable are embodiments, where the slider 4 is placed in the slider channel 5 only after the reformation of the edges 11, 12.

Figure 5:
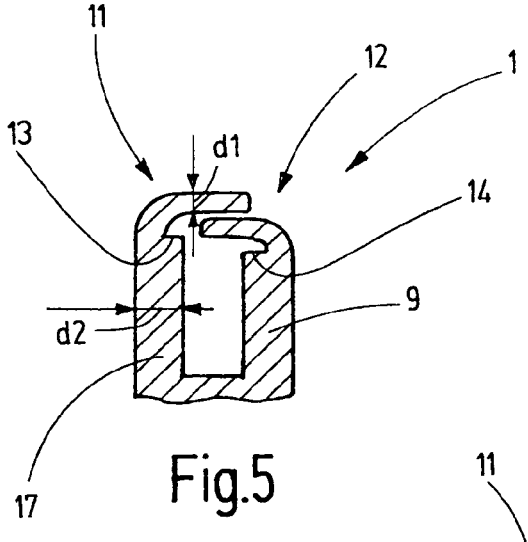
FIG. 5 is a cross-sectional view of an enlarged detail, without slider, of a modified embodiment of the compound needle in accordance with FIG. 1.

Considering the so-far described exemplary embodiment of the compound needle 1, numerous modifications are possible, in particular as regards the shaping of the edges 11, 12. Referring to the exemplary embodiment in accordance with FIG. 4, the steps 13, 14 are located at the same height, whereby the slider 4 may project beyond the steps 13, 14. However, the steps 13, 14 may also be located at different heights. This may be advantageous when the edges 11, 12 are to overlap, as shown by FIG. 5. In so doing, the edges 11, 12 may have a greater height or length than is shown by the exemplary embodiment in accordance with FIG. 4. Whereas in this case the lateral walls 8, 9 are arranged, including their edges 11, 12, symmetrically toward a center plane M, the lateral walls 8, 9 of the compound needle 1 in accordance with FIG. 5 are arranged asymmetrically with respect to the same center plane. The steps 13, 14 may be provided at different heights. The edges 11, 12 may overlap each other. The edges 11, 12 may rest loosely on each other, delimit a distance with each other, or be connected to each other along the entire length, in sections or at points.

Figure 6:
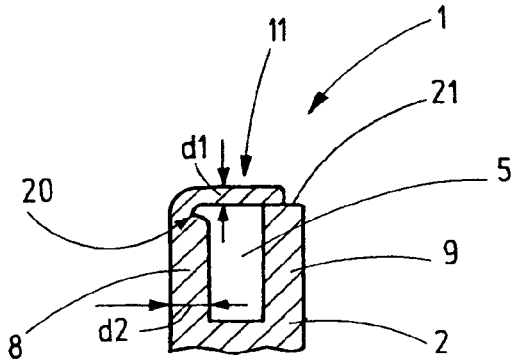
FIG. 6 and FIG. 7 are enlarged cross-sectional views, without slider, of additional embodiments of the compound needle in accordance with FIG. 1.

FIG. 6 shows another embodiment. In this case only the lateral wall 8 is provided with the edge 11, whereas the lateral wall 9 does not have an edge 12 with reduced thickness. The transition from the thickness d2 to the thickness d1 of the lateral wall 8 may occur in a step or also, as illustrated, occur with another molded element, for example, having the configuration of a curve 20. The edge 11 may enclose a part of the slider channel 5 or, as also shown, rest on the upper flat front face 21 of the lateral wall 9. There, said edge may be loosely supported or be connected to the front face 21 by suitable connecting means such as, e.g., laser welding, along the entire length, in sections or at points.

It is pointed out that other embodiments are also possible, i.e., where the edge 11, has—e.g., in its flat horizontal section in FIG. 6—a thickness that corresponds to, or at least approximately corresponds to, the thickness d2. The thickness reduction of the edge 11 may be restricted to one location, e.g., the curve 20. This "location" may be provided—in longitudinal direction—in the form of a line-like groove on the inside and/or outside of the lateral wall 8. This type of thickness reduction may also be used in all the other embodiments described herein.

Figure 7:
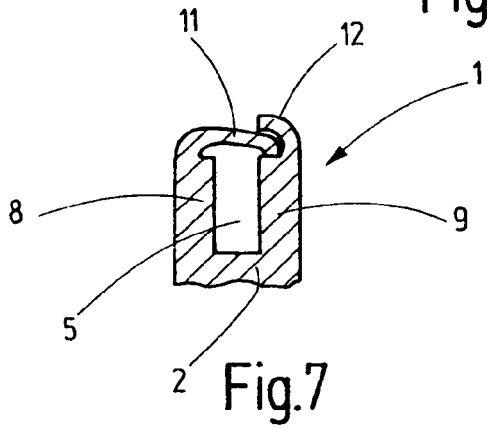

Furthermore, a modification in accordance with FIG. 7 is possible. In this case, the lateral walls 8, 9 are again configured asymmetrically with respect to each other, whereby the lateral wall 8 is provided with a long edge 11, and the lateral wall 9 is provided with a short edge 12. The short edge 12 extends around the long edge 11, holding said long edge at the lateral wall 9.

Additional modifications regarding other details of the compound needle 1 are possible, said modification not necessarily being related to the configuration of the slider channel 5 and therefore not requiring special mention at this point. It is pointed out only as an example that the feet 6, 7—different from the drawing—may also be differently oriented, that the tip of the slider 4 or the hook 3 may have a different form than the one as illustrated, and that the needle body 2 may be provided with other molded elements such as recesses, openings or the like.

The compound needle 1 in accordance with the invention has a slider channel 5 that is delimited by two lateral walls 8, 9. At least one of the lateral walls 8, 9 has, in its upper edge region 11, 12, a reduced thickness d1. The edge 11 of the lateral wall 8 is bent, respectively, toward the other lateral wall 9. Due to the reduced thickness d1, a narrow bending radius can be achieved, as a result of which the needle channel 5 can be better approximated—in cross-section—to a rectangular form than was possible until now. This allows the slider 4 to better utilize the clearance height of the slider channel 5.

It will be appreciated that the above description of the present invention is susceptible to various modifications, changes and modifications, and the same are intended to be comprehended within the meaning and range of equivalents of the appended claims.

Reference Numbers

1 Compound needle
2 Needle body
3 Hook
4 Slider
5 Slider channel
6, 7 Foot
8, 9 Lateral walls
10 Floor
11, 12 Edges
13, 14 Step
15, 16 Throat
17, 18 Lateral surfaces
19 Joint (gap)
M Center plane
20 Curve
21 Front face

What is claimed is:

1. Compound needle having a needle body with a slider channel, in which a slider is arranged so that it can be shifted and which is delimited by two lateral walls, and wherein the upper edge of at least one of the lateral walls is bent toward the edge of the other lateral wall in order to close the slider channel, the lateral wall has, on its bent edge, a reduced thickness (d1) in at least one location, and the upper edges overlap each other.

2. Compound needle having a needle body with a slider channel, in which a slider is arranged so that it can be shifted and which is delimited by two lateral walls, and wherein the upper edge of at least one of the lateral walls is bent toward the edge of the other lateral wall in order to close the slider channel, and the at least one lateral wall has, on its bent edge, a reduced thickness (d1) in at least one location, and a step, at which the thickness (d2) of the lateral wall is reduced to the lower thickness (d1) of the edge.

3. Compound needle in accordance with claim 2 wherein the upper edges, together, form a gap which is narrower than the slider channel.

4. Compound needle in accordance with claim 2, wherein the step is provided on the side of the lateral wall, said side facing the slider channel.

5. Compound needle in accordance with claim 2, wherein the two lateral walls have, on their respective upper edges, a reduced thickness (d1).

6. Compound needle in accordance with claim 2, wherein the lateral walls of the compound needle are configured so as to be symmetrical to each other relative to a center plane (M).

7. Compound needle in accordance with claim 2, wherein the at least one lateral wall is bent exclusively at its edge displaying the reduced thickness and is otherwise not bent.

8. Compound needle in accordance with claim 2, wherein the reduced thickness (d1) of the upper edge is greater than 0.1 mm.

9. Compound needle in accordance with claim 2, wherein the upper edges, together, form a joint, where said edges contact each other.

* * * * *